United States Patent [19]

Burton

[11] Patent Number: 4,774,894

[45] Date of Patent: Oct. 4, 1988

[54] SMOKELESS BURNING SYSTEM AND METHOD

[76] Inventor: R. Edward Burton, 23881 Sherwood Rd., Willits, Calif. 95490

[21] Appl. No.: 15,436

[22] Filed: Feb. 17, 1987

[51] Int. Cl.[4] ..... F23B 7/00

[52] U.S. Cl. ..... 110/233; 110/108; 110/228; 110/257; 110/259; 110/289; 110/346

[58] Field of Search ..... 110/227, 228, 108, 109, 110/289, 257, 259, 224, 346, 234, 233

[56] References Cited

U.S. PATENT DOCUMENTS

| | | | |
|---|---|---|---|
| 18,059 | 8/1857 | Richards | 110/228 X |
| 3,855,950 | 12/1974 | Hughes, Jr. et al. | 110/109 X |
| 4,091,748 | 5/1978 | Mansfield | 110/228 |
| 4,329,931 | 5/1982 | Burton | 110/346 |
| 4,474,117 | 10/1984 | Marollaud | 110/109 |
| 4,479,441 | 10/1984 | Somodi | 110/257 |

*Primary Examiner*—Edward G. Favors
*Attorney, Agent, or Firm*—Flehr, Hohbach, Test, Albritton & Herbert

[57] ABSTRACT

System and method for burning wood and other fuel materials in a substantially smokeless manner. The fuel material is fed to the inlet end of an inverse pile burning chamber through an air lock chamber having inlet and outlet gates to prevent smoke from escaping from the inlet end of the burning chamber. The burning chamber is inclined in a downward direction from its inlet end to its outlet end, and the angle of inclination can be adjusted to facilitate the passage of different types of fuel material through the burning chamber. Combustion gases from the burning chamber are utilized for drying the fuel material before the material is delivered to burning chamber.

47 Claims, 3 Drawing Sheets

SMOKELESS BURNING SYSTEM AND METHOD

This invention pertains generally to burning systems and methods, and more particularly to a system and method for burning a variety of fuels in a substantially smokeless manner.

In many localities, there are large quantities of waste materials such as wood scraps, bark, underbrush and wheat straw which could be used as fuel if a burning system were available to burn the material in compliance with local air pollution standards. Even in rural areas, incinerators and other burning systems are required to operate in an essentially smokeless manner and to emit combustion gases of various types and particulates in concentrations less than specified levels. Most localities in the United States require that burning systems emit a level of smoke less than a Ringleman rating of 1, which means, neglecting steam and water vapor, only very slight wisps of smoke are visible to the eye. Waste materials such as wood scraps, bark, underbrush and wheat straw often have substantial moisture content and are difficult to burn without emitting substantial smoke.

The burning of unseasoned wood scraps and other fuels having a substantial water content is a three-step process. As the fuel is brought to the ignition temperature (about 400° F. for wood) water vapor is given off as the fuel goes through a drying phase. As the fuel starts to burn, combustible gases and burned carbon particles are sent off in the form of smoke. This can be called the volatile burning phase. Thereafter, the fuel enters a charcoal phase in which the fuel burns at a much higher temperature, with very little water vapor, combustible gases and unburned carbon being emitted. Subsequently, the fuel enters the ash phase in which substantially all of the combustible portions of the material have been burned, leaving a generally incombustible residue.

Heretofore, several different approaches have been taken to the problem of burning fuels with substantial moisture content in a substantially smokeless manner. In one such approach, an afterburner is employed to achieve more complete combustion of volatile gases and unburned carbon particles emanating from the burning material. In another approach, the time the fuel remains in the combustion zone (above 500° F.) is extended, and combustion air (oxygen) is supplied to the combustion zone. In a third approach, new fuel is conveyed into the burning chamber beneath the material which is already is burning so the volatile gases and unburned particles will be burned in passing through the vertically adjacent zone in which material is burning in a charcoal phase. Each of these approaches has certain limitations and disadvantages.

U.S. Pat. Nos. 4,329,931 and 4,429,645 disclose an inverse pile burner which has proven to be very effective in achieving substantially smokeless burning of wood and other materials which are strong enough to be pushed through the burner. In this system, an elongated volume of new fuel is pushed into the lower front end of a burning chamber, and this new fuel pushes the fuel which is already burning in the chamber toward the rear of the chamber to establish a fuel drying zone in the lower front portion of the chamber, a volatile burning zone adjacent to and substantially overlying the fuel drying zone in a central portion of the chamber, and a charcoal burning zone adjacent to and, substantially overlying the volatile burning zone in the rear portion of the chamber. Incomplete combustion products from the volatile burning zone pass through and across the charcoal burning zone and are substantially completely burned therein before exiting the rear of the chamber.

In the system disclosed in U.S. Pat. No. 4,329,931, the burner is tilted in an upward direction from front to rear, allowing the natural draft to draw the gases up the stack. With this system, there is no need for a tight closure at the inlet or front end of the burner. This system does, however, require that the fuel have sufficient structural strength to permit the fuel mass to be pushed up through the burner.

In the system disclosed in U.S. Pat. No. 4,429,645, the burner is in a substantially level position, and it has a tight fitting feed gate which is opened to admit each charge of fuel. The level orientation improves the movement of fuel through the burner, but some smoke may escape from the inlet end of the burner when the gate is open. The improved fuel movement makes it possible to feed the fuel faster than it is burned so that a salable grade of charcoal can be recovered from the system. Even though the fuel movement is easier with the level burner, this system still requires material with some structural strength in order to be pushed through the burner.

Unfortunately, much of the material available for burning has little or no structural strength and therefore cannot be pushed through a burning chamber in a manner required by the system disclosed in U.S. Pat. Nos. 4,329,931 and 4,429,645. Many of these materials are also too stringy, hard or bulky to be fed beneath a burning mass of material by means of conveyors, such as screw conveyors, star feeders or walking floor conveyors.

It is in general and object of the invention to provide a new and improved system and method for burning wood and other materials in a substantially smokeless manner.

Another object of the invention is to provide a system and method of the above character which can be utilized with materials which do not have sufficient structural strength to be pushed through a burning chamber.

Another object of the invention is to provide a system and method of the above character in which heat produced by the combustion of the fuel materials is utilized for drying the materials before they are fed into the chamber.

These and other objects are achieved in accordance with the invention by feeding fuel material to an inverse pile burner through an air lock chamber having inlet and outlet gates to prevent smoke from escaping from the inlet end of the burning chamber. The fuel material is fed into a hopper positioned above the air lock chamber with the inlet and outlet gates both closed. With the outlet gate closed, the inlet is opened to pass the fuel material to the air lock chamber. Thereafter, the inlet gate is closed, and the outlet gate is opened to pass the material from the air lock chamber toward the burning chamber. The burning chamber is inclined in a downward direction from its inlet end to its outlet end, and the angle of inclination can be adjusted to facilitate the passage of different types of fuel material through the burning chamber. Combustion gases from the burning chamber are utilized for drying the fuel material before the material is fed into the hopper.

Figure 1:
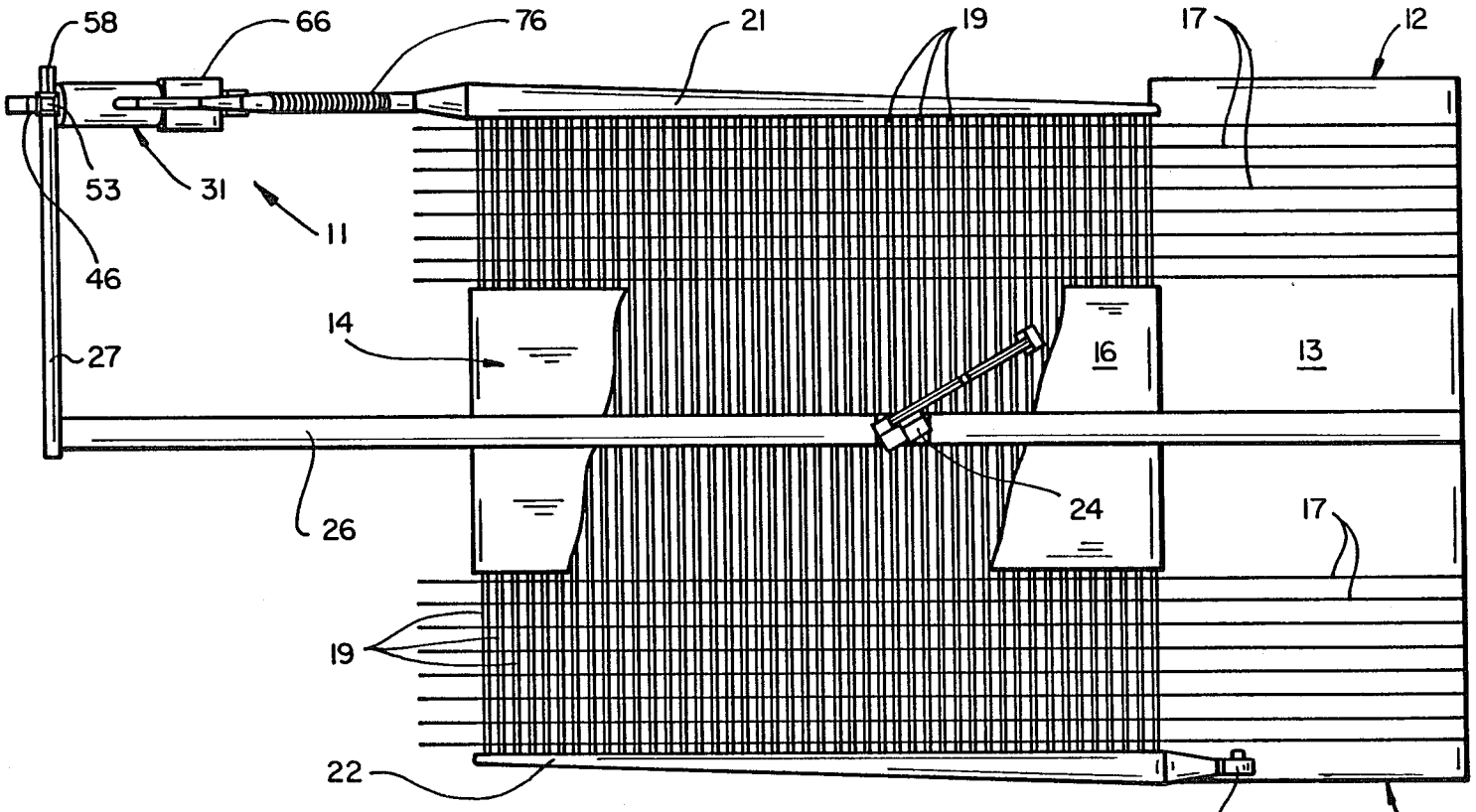
FIG. 1 is a top plan view, somewhat schematic and partly broken away, of one embodiment of apparatus for burning wood and other materials according to the invention.
Figure 2:
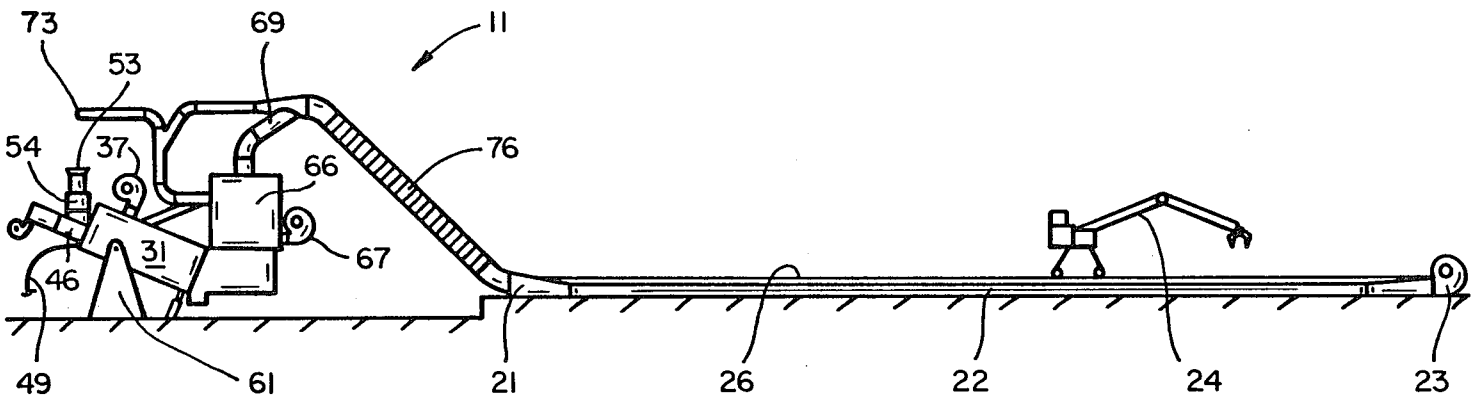
FIG. 2 is a side elevational view, partly schematic, of the embodiment FIG. 1.
Figure 3:
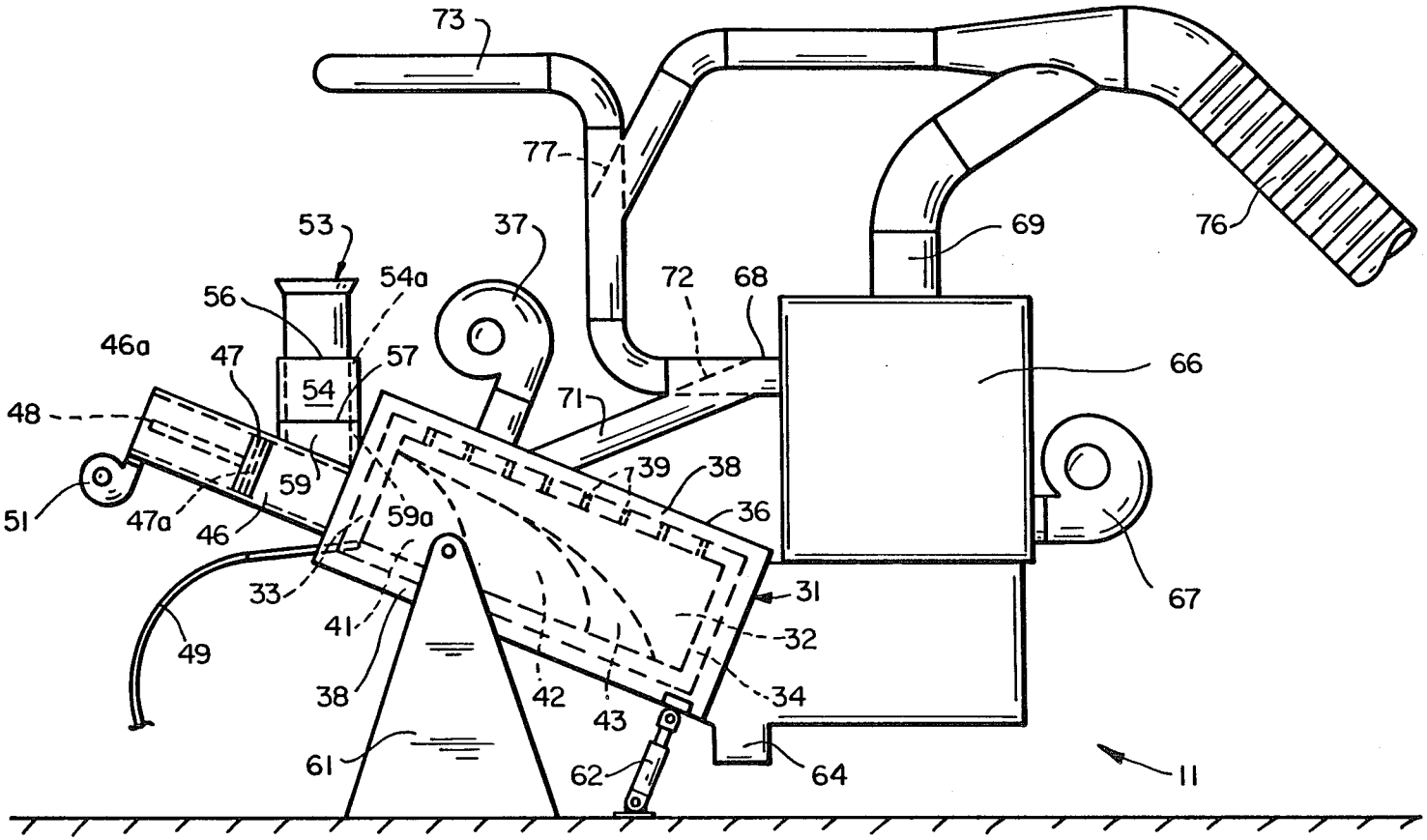
FIG. 3 is an enlarged side elevational view, somewhat schematic, of a portion of the burning system in the embodiment of FIG. 1.

As illustrated in FIG. 1, the system includes a burner 11, a pair of lumber loading areas 12, a bulk material dumping area 13, and a heated area or platform 14 for drying the lumber and other materials to be burned. The drying platform comprises a central deck 16 flanked by a plurality of laterally spaced longitudinally extending rails 17 on either side of the deck. The deck has a generally horizontal surface, and can be fabricated of any suitable material such as a steel plate or a concrete slab. The rails extend through the lumber loading areas, and they can be of any suitable type such as the rails or track commonly employed in kilns for drying lumber.

The lumber loading areas 12 and the bulk material dumping area 13 are located toward one end of the drying platform, they can be paved or otherwise surfaced to accommodate the fuel materials and the trucks or other vehicles which deliver them to the burning station.

Means is provided for heating wood and other fuel materials on the drying platform. This means includes a plurality of heating pipes 19 which extend transversely of the platform between an inlet manifold or plenum chamber 21 and an outlet manifold or plenum chamber 22. The inlet manifold receives a heated fluid such as hot air from burner 11 and delivers it to the heating pipes. The hot air is drawn through the heating pipes and discharged through the atmosphere by a blower 23 at the outlet end manifold 22. The heating pipes extend beneath rails 17 and beneath the surface of deck 16. With a steel plate deck, the pipes are positioned beneath the deck, and with a concrete slab, they are embedded in the concrete.

A knuckle boom 24 mounted on longitudinally extending tracks 26 transfers the lumber and other fuel materials between the loading areas, the drying platform and a belt conveyor 27 which carries the material to the burner. Another type of conveyor such as a front end loader or another suitable conveyor can be utilized for this purpose, if desired.

Burner 11 is an inverse pile burner of the type disclosed in U.S. Pat. Nos. 4,329,931 and 4,429,645. This burner has an elongated cylinder 31 of refractory material which defines a burning chamber 32 with walls 33 and 34 of refractory material at the inlet and outlet ends of the chamber, respectively. A metal housing 36 surrounds the refractory cylinder, and a blower 37 introduces air into the space 38 between the outer housing and the inner cylnder. This air is admitted to chamber 32 through longitudinally spaced openings 39 in the upper portion of chamber wall 31 to supply oxygen which supports combustion of the fuel material within the chamber.

As discussed in detail in U.S. Pat Nos. 4,329,931 and 4,429,645, burning zones are formed as the fuel material is burned in chamber 32. These include a fuel drying zone 41 located in the lower portion of the chamber toward the inlet end, a volatile burning zone 42 adjacent to and substantially overlying the drying zone, and a charcoal burning zone 43 adjacent to and substantially overlying the volatile burning zone. The exact size and location of these zones changes as the fuel burns and new material is fed into the burning chamber.

Fuel material is fed into the lower portin of the inlet end of burning chamber 32 from an accumulation chamber 46 through openings (not shown) in the end walls of housing 36 and cylinder 31. The accumulation chamber 46 has a generally circular cross section, and a ram 47 is slideably mounted in this chamber for pushing the fuel material into the burning chamber. The ram has an operating rod 48 which passes through an opening at the outer end of the accumulation chamber and is connected to a hydraulic or pneumatic actuator.

A gas jet 49 introduces a combustible gas into the lower portion of the inlet end of burning chambers 32 to assist in the combustion of the fuel material in the chamber. The gas is particularly helpful in starting fires with wet materials and materials which are otherwise difficult to burn.

A blower 51 blows air into the accumulation chamber 46 at a pressure higher than the the pressure and burning chamber 32. This prevents smoke from escaping from the system through the accumulation chamber or through the opening for gas jet 49.

A hopper 53 is positioned vertically above the accumulation chamber 46 for receiving fuel material from conveyor belt 27. The hopper is open at the top, and an air lock chamber 54 is positioned between the hopper and the accumulation chamber to prevent smoke from escaping from the inlet end of the burning chamber through the hopper. An inlet gate 56 and an outlet gate 57 are provided on the upper and lower sides of the air lock chamber, respectively. These gates are adapted to slide horizontally between open and closed positions, and in the closed positions, they serve as bottom walls for the hopper and the air lock chamber. The gates are moved between their opened and closed positions by hydraulic or pneumatic actuators 58. A short delivery chute 59 extends between air lock chamber 54 and accumulation chamber 46 in open communication with the accumulation chamber. Accumulation chamber 46, ram 47, air lock chamber 54 and delivery chute 59 have cooling jackets which a coolant **46*a*, 47*a*, 54*a* and 59*a*** through which a coolant is circulated. The jackets are preferably supplied individually, rather than being connected in series, to provide more complete and more uniform cooling of the different chambers.

The burner is pivotally mounted on a base 61 with the burning chamber being inclined in a downward direction from the inlet end toward the outlet end. This inclination is possible because blower 51 and air lock chamber 54 prevent the escape of smoke from the inlet end of the burning chamber. The downward inclination facilitates the movement of fuel material through the chamber, and it permits material without longitudinal or structural strength to be burned. A hydraulic or pneumatic cylinder 62 permits the angle of inclination to be adjusted to accommodate different types of fuel materials. With wood blocks, for example, the chamber might be tilted at an angle of 20° from the horizontal. With stringy materials such as cotton trash, brush, a greater angle (e.g., 23°) would be employed, whereas a lesser angle (e.g., 18°) would be employed with rounded materials such as round chunks of wood or coal.

An ash trough 64 is provided at the outlet end of the burning chamber. With the downward inclination of the burning chamber, the fuel material is readily passed through the chamber faster than it burns, thereby producing charcoal which can be collected in the ash trough.

A heat exchanger 66 receives the effluvia or gases produced by the combustion of the fuel material in chamber 32. The heat exchanger is mounted at the outlet end of the burning chamber and receives the combustion gases from this end of the chamber. A blower 67 supplies air to the heat exchanger, and the effluvia combustion gases and the heated air are discharged from the heat exchanger through ducts 68, 69 respectively.

A return duct 71 is connected between outlet duct 68 and chamber housing 36 for supplying heated air to the burning chamber to enhance combustion of the fuel material. A diverter vane 72 is moveable between open and closed positions relative to the return duct for determining whether the heated air is delivered to the return duct or to an outlet duct 73. The heated air from outlet duct 73 can be utilized as desired.

Outlet duct 69 supplies hot air to heating pipes 19 thru a flexible duct 76. All or part of the heated air from duct 73 can also be diverted to the heating pipes by means of a diverter vane 77 in duct 73.

Operation and use of the burning system, and therein the method of the invention, are as follows. Wood and other materials to be burned are delivered to receiving areas 12, 13 and transferred to drying platform 14 by knuckle boom 24. The dried material is transferred from the platform to conveyor belt 27 for delivery to hopper 53.

Air lock gates 56, 57 are both maintained in a normally closed position to prevent the escape of smoke from the inlet end of the burning chamber. When the hopper has been filled, inlet gate 56 is opened to permit the material to pass from the hopper to air lock chamber 54. When this transfer has been completed, the inlet gate is closed. Thereafter, outlet gate 57 is opened to permit the fuel material to drop from the air lock chamber through chute 59 to accumulation chamber 46. When this transfer has been completed, outlet gate 57 is once again closed. Inlet gate 56 remains closed while the outlet gate is open to prevent smoke from escaping through the hopper.

The fuel material in accumulation chamber 46 is pushed into the inlet end of burning chamber 32 by RAM 47. This new fuel material is received beneath the material which is already burning in the chamber, and the introduction of the new material serves to move the material which is already burning toward the outlet end of the chamber. Thus, the material from drying zone 41 is moved to volatile burning zone 42, and the material from the volatile burning zone is moved to charcoal burning zone 43. The material (e.g., ashes and charcoal) from charcoal burning zone 43 is discharged into trough 64.

Blower 37 is normally operated to maintain a pressure on the order of 0.5 inch static water pressure in the burning chamber. This provides a gentle flow of air over the fire and avoids the formation of clinkers and particulates as the fire burns. Blower 51 operates continuously to maintain a pressure on the order of 1.5 inch static water pressure in the accumulation chamber 46. Since the pressure in the accumulation chamber is higher than the burning chamber, smoke does not pass into the accumulation chamber from the burning chamber, and smoke cannot escape from this portion of the system.

The combustion gases leave the outlet end of the burning chamber 32 at a temperature on the order of 2,000° F., and air is brought into the heat exchanger by blower 67 at a temperature on the order of 60° F. The air delivered to outlet ducts 68, 69 is at a temperature on the order of 450°-600° F. The air delivered to inlet manifold 21 is typically at a temperature on the order of 500° F., and by the time this air reaches outlet manifold 22, it has cooled to a temperature of about 200° F.

With fuel materials which are particularly wet or otherwise difficult to burn, blower 37 is turned off, and heated air is introduced into the burning chamber from heat exchanger 66 thru return duct 71. This air is typically at a temperature on the order of 200° F. A butterfly valve or damper at the outlet of blower 37 prevents the heated air and smoke from escaping through the blower.

The operation of conveyor 27, gates 56, 57 and RAM 47 can be controlled by a timer (not shown) to provide automated operation of the system.

It is apparent from the foregoing that a new and improved system and method for burning wood and other materials in a substantially smokeless manner have been provided. While only certain presently preferred embodiments have been described in detail, as will apparent to those familiar with the art, certain changes and modifications can be made without departing from the scope of the invention as defined by the following claims.

What is claimed:

1. In a system for burning wood and other fuel materials: an elongated, pivotally mounted burning chamber having inlet and outlet ends and being capable of being tilted to different angles of inclination to facilitate movement of material through the chamber, an accumulation chamber at the inlet end of the burning chamber, a hopper for receiving fuel material to be burned, an air lock chamber positioned between the hopper and the accumulation chamber, a first gate between the hopper and the air lock chamber for passing the fuel material from the hopper to the air lock chamber when opened and preventing the passage of smoke from the air lock chamber to the hopper when closed, a second gate between the air lock chamber and the accumulation chamber for passing the fuel material from the air lock chamber to the accumulation chamber when opened and preventing the passage of smoke from the burning chamber to the air lock chamber when closed, and means for pushing the fuel material from the accumulation chamber into the inlet end of the burning chamber and thereby causing material already in the chamber to move down the inclined chamber toward the outlet end.

2. The system of claim 1 wherein the gates slide horizontally and serve as bottom walls of the hopper and the air lock chamber when closed.

3. The system of claim 1 including means for cooling the air lock chamber.

4. The system in claim 1 including a heat exchanger connected to the outlet end of the burning chamber for utilizing the heat energy in gases produced by combustion of the fuel material in the burning chamber.

5. The system of claim 4 including means for returning heated air from the heat exchanger to the burning chamber to enhance the combustion of the fuel material in the burning chamber.

6. The system of claim 4 including a platform for drying the fuel material before it is delivered to the hopper, and means connected to the heat exchanger for heating the fuel material on the platform.

7. The system of claim 6 wherein the means for heating the fuel material comprises heating pipes in the platform in fluid communication with the heat exchanger.

8. The system of claim 6 including means for transferring the dried fuel material from the platform to the hopper.

9. In a system for burning wood and other fuel materials: an elongated burning chamber which is pivotally mounted and can be tilted to different angles of inclination, an accumulation chamber at the inlet end of the burning chamber, means for pushing fuel material from the accumulation chamber into the inlet end of the burning chamber, a hopper positioned above the accumulation chamber for receiving fuel material to be delivered to the accumulation chamber, an air lock chamber positioned between the hopper and the accumulation chamber, a first gate between the hopper and the air lock chamber for passing the fuel material from the hopper to the air lock chamber when opened and preventing the passage of smoke from the air lock chamber to the hopper when closed, and a second gate between the air lock chamber and the accumulation chamber for passing the fuel material from the air lock chamber to the accumulation chamber when opened and preventing the passage of smoke from the accumulation chamber to the air lock chamber when closed.

10. The system of claim 9 wherein the gates slide horizontally and serve as bottom walls of the hopper and the air lock chamber when closed.

11. The system of claim 9 including a heat exchanger connected to the outlet end of the burning chamber for utilizing heat energy in gases produced by combustion of the fuel material in the burning chamber.

12. The system of claim 11 including means for returning heated air from the heat exchanger to the burning chamber to enhance the combustion of the fuel material in the burning chamber.

13. The system of claim 11 including a platform for drying the fuel material before it is delivered to the hopper, and means connected to the heat exchanger for heating the fuel material on the platform.

14. The system of claim 13 wherein the means for heating the fuel material comprises heating pipes in the platform in fluid communication with the heat exchanger.

15. The system of claim 13 including means for transferring the dried fuel material from the platform to the hopper.

16. In a system for burning wood and other fuel materials: an elongated burning chamber having inlet and outlet ends, a platform for receiving fuel material to be burned in the burning chamber, an accumulation chamber at the inlet end of the burning chamber, a hopper positioned above the accumulation chamber, means for transferring the fuel material from the platform to the hopper, an air lock chamber positioned between the hopper and the accumulation chamber, a first gate between the hopper and the air lock chamber for passing the fuel material from the hopper to the air lock chamber when opened and preventing the passage of smoke from the air lock chamber to the hopper when closed, a second gate between the air lock chamber and the accumulation chamber for passing fuel material from the air lock chamber to the accumulation chamber when opened and preventing the passage of smoke from the burning chamber to the air lock chamber when closed, a plurality of heating pipes in the platform, and means for passing hot gases produced by combustion of the fuel material in the burning chamber through the heating pipes to the dry the fuel material on the platform.

17. The system of claim 16 including means for pushing the fuel material from the accumulation chamber into the inlet end of the burning chamber in such manner that this material causes fuel material already burning in the burning chamber to move toward the outlet end of the burning chamber.

18. The system of claim 16 including means for introducing air into the accumulation chamber at a pressure higher than the pressure in the burning chamber to prevent smoke from passing out of the system through the accumulation chamber.

19. The system of claim 16 wherein the burning chamber is inclined in a downward direction from the inlet toward the outlet end.

20. The system of claim 16 wherein the burning chamber is pivotally mounted and can be be tilted to different angles of inclination to adjust the relative heights of the inlet ends and outlet ends of the chamber.

21. The system of claim 16 wherein the gates slide horizontally and serve as bottom walls of the hopper and the air lock chamber when closed.

22. In a method of burning wood and other fuel materials in a system having an elongated burning chamber, an accumulation chamber at the inlet end of the burning chamber, a hopper, and an air lock chamber with inlet and outlet gates positioned between the hopper and the accumulation chamber, the steps of: tilting the burning chamber so that the outlet end of the chamber is lower than the inlet end, placing the fuel material in the hopper with the inlet gate closed to prevent the passage of smoke from the air lock chamber to the hopper, opening the inlet gate to pass the fuel material from the hopper to the air lock chamber with the outlet gate closed to prevent the passage of smoke from the burning chamber to the air lock chamber, closing the inlet gate after the fuel material has passed to the air lock chamber, opening the outlet gate to pass the fuel material from the air lock chamber to the accumulation chamber with the inlet gate closed to prevent the passage of smoke from the burning chamber to the hopper, and transferring the fuel material from the accumulation chamber to the burning chamber.

23. The method of claim 22 wherein the fuel material is pushed from the accumulation chamber into the burning chamber.

24. The method of claim 22 wherein the burning chamber is tilted at different angles for different types of fuel material.

25. The method of claim 22 including the step of introducing heated air into the burning chamber to enhance combustion of the fuel material.

26. The method of claim 25 wherein the heated air is obtained from a heat exchanger connected to the outlet end of the burning chamber.

27. In a method of burning wood and other fuel materials in a system having a drying platform, an elongated burning chamber, an accumulation chamber at the inlet end of the burning chamber, a hopper, and an air lock chamber with inlet and outlet gates positioned between the hopper and the accumulation chamber, the steps of: placing the fuel material on the drying platform, passing a fluid heated by combustion of fuel material in the burning chamber through heating pipes in the platform to dry the fuel material, transferring the dried fuel material from the platform to the hopper with the inlet gate closed to prevent the passage of smoke from the air lock chamber to the hopper, opening the inlet gate to pass the fuel material from the hopper to the air lock chamber with the outlet gate closed to prevent the passage of smoke from the burning chamber to the air lock chamber, closing the inlet gate, opening the outlet gate to pass the fuel material from the air lock chamber to the accumulation chamber with the inlet gate closed to prevent the passage of smoke from the burning chamber to the air lock chamber, and transferring the fuel material from the accumulation chamber to the burning chamber.

28. The method of claim 27 wherein the fuel material is pushed from the accumulation chamber into the burning chamber.

29. The method of claim 28 including the step of introducing air into the accumulation chamber at a pressure higher than the pressure in the burning chamber to prevent smoke from passing out of the system through the accumulation chamber.

30. The method of claim 27 including the step of tilting the burning chamber so that outlet end of the chamber is lower than inlet end.

31. The method of claim 30 wherein the burning chamber is tilted at different angles for different types of fuel material.

32. The method of claim 27 including the step of introducing heated air from the heat exchanger into the burning chamber to enhance combustion of the fuel material.

33. In a system for burning wood and other fuel materials: an elongated burning chamber having inlet and outlet ends, a platform for receiving fuel material to be burned in the burning chamber, a hopper positioned above the inlet end of the burning chamber, means for transferring the fuel material from the platform to the hopper, an air lock chamber positioned between the hopper and the inlet end of the burning chamber, a first gate between the hopper and the air lock chamber for passing the fuel material from the hopper to the air lock chamber when opened and preventing the passage of smoke from the air lock chamber to the hopper when closed, a second gate between the air lock chamber and the inlet end of the burning chamber for passing fuel material from the air lock chamber toward the burning chamber when opened and preventing the passage of smoke from the burning chamber to the air lock chamber when closed, a plurality of heating pipes in the platform, means for passing a fluid heated by combustion of the fuel material in the burning chamber through the heating pipes to the dry fuel material on the platform, and circulating means for cooling the air lock chamber.

34. The system of claim 33 including a heat exchanger connected to the outlet end of the burning chamber for supplying the heated fluid to the heating pipes.

35. In a system for burning wood and other fuel materials: an elongated burning chamber having inlet and outlet ends, a platform for receiving fuel material to be burned in the burning chamber, a hopper positioned above the inlet end of the burning chamber, means for transferring the fuel material from the platform to the hopper, an air lock chamber positioned between the hopper and the inlet end of the burning chamber, a first gate between the hopper and the air lock chamber for passing the fuel material from the hopper to the air lock chamber when opened and preventing the passage of smoke from the air lock chamber to the hopper when closed, a second gate between the air lock chamber and the inlet end of the burning chamber for passing fuel material from the air lock chamber toward the burning chamber when opened and preventing the passage of smoke from the burning chamber to the air lock chamber when closed, a plurality of heating pipes extending across the platform in a first direction, an inlet manifold connected to one end of the pipes for receiving hot gases produced by combustion of the fuel material in the burning chamber, an outlet manifold connected to the other end of the pipes, and a blower connected to the outlet manifold for discharging heated fluid passing through the heating pipes from the inlet manifold.

36. The system of claim 35 including a heat exchanger connected between the outlet end of the burning chamber and the inlet manifold for supplying the hot gases to the inlet manifold.

37. In a method of burning wood and other fuel materials in a system having an elongated burning chamber, a hopper, and an air lock chamber with inlet and outlet gates positioned between the hopper and the inlet end of the burning chamber, the steps of: placing the fuel material in the hopper with the inlet gate closed to prevent the passage of smoke from the air lock chamber to the hopper, opening the inlet gate to pass the fuel material from the hopper to the air lock chamber with the outlet gate closed to prevent the passage of smoke from the burning chamber to the air lock chamber, closing the inlet gate after the fuel material has passed to the air lock chamber, opening the outlet gate to pass the fuel material from the air lock chamber toward the burning chamber with the inlet gate closed to prevent the passage of smoke from the burning chamber to the hopper, and cooling the air lock chamber with a circulating coolant.

38. In a method of burning wood and other fuel materials in a system having a drying platform, an elongated burning chamber, an accumulation chamber at the inlet end of the burning chamber, a hopper, and an air lock chamber with inlet and outlet gates positioned between the hopper and the inlet end of the accumulation chamber, the steps of: placing the fuel material on the drying platform, passing a fluid heated by combustion of the fuel material in the burning chamber through heating pipes in the platorm to dry the fuel material, transferring the dried fuel material from the platform to the hopper with the inlet gate closed to prevent the passage of smoke from the air lock chamber to the hopper, opening the inlet gate to pass the fuel material from the hopper to the air lock chamber with the outlet gate closed to prevent the passage of smoke from the burning chamber to the air lock chamber, closing the inlet gate, and opening the outlet gate to pass the fuel material from the air lock chamber to the accumulation chamber with the inlet gate closed to prevent the passage of smoke from the burning chamber to the air lock chamber, pushing the fuel material from the accumulation chamber into the burning chamber, and cooling the air lock chamber and the accumulation chamber with a circulating coolant.

39. The method of claim 38 wherein the heated fluid is supplied to the heating pipes from a heat exchanger connected to the outlet end of the burning chamber.

40. The system of claim 16 including a heat exchanger connected to the outlet end of the burning chamber for supplying hot gases to the means for passing the hot gases through the heating pipes.

41. The method of claim 27 wherein the fluid passed through the heating pipes is obtained from a heat exchanger connected to the outlet end of the burning chamber.

42. In a system for burning wood and other fuel materials: an elongated burning chamber having inlet and outlet ends and being inclined in a downward direction from the inlet end toward the outlet end to facilitate movement of material through the chamber, an accumulation chamber at the inlet end of the burning chamber, a hopper for receiving fuel material to be burned, an air lock chamber positioned between the hopper and the accumulation chamber, a first gate between the hopper and the air lock chamber for passing the fuel material from the hopper to the air lock chamber when opened and preventing the passage of smoke from the air lock chamber to the hopper when closed, a second gate between the air lock chamber and the accumulation chamber for passing the fuel material from the air lock chamber to the accumulation chamber when opened and preventing the passage of smoke from the burning chamber to the air lock chamber when closed, means for pushing the fuel material from the accumulation chamber into the inlet end of the burning chamber and thereby causing material already in the chamber to move down the inclined chamber toward the outlet end, and means for introducing air into the accumulation chamber at a pressure higher than the pressure in the burning chamber to prevent smoke from the burning chamber from passing out of the system through the accumulation chamber.

43. In a system for burning wood and other fuel materials: an elongated burning chamber inclined in a downward direction from the inlet end to the outlet end of the chamber, an accumulation chamber at the inlet end of the burning chamber, means for pushing fuel material from the accumulation chamber into the inlet end of the burning chamber, a hopper positioned above the accumulation chamber for receiving fuel material to be delivered to the accumulation chamber, an air lock chamber positioned between the hopper and the accumulation chamber, a first gate between the hopper and the air lock chamber for passing the fuel material from the hopper to the air lock chamber when opened and preventing the passage of smoke from the air lock chamber to the hopper when closed, a second gate between the air lock chamber and the accumulation chamber for passing the fuel material from the air lock chamber to the accumulation chamber when opened and preventing the passage of smoke from the accumulation chamber to the air lock chamber when closed, and means for introducing air into the accumulation chamber at a pressure greater than the pressure in the burning chamber to prevent smoke from passing out of the system through the accumulation chamber.

44. In a system for burning wood and other fuel materials: an elongated burning chamber inclined in a downward direction from the inlet end to the outlet end of the chamber, an accumulation chamber at the inlet end of the burning chamber, means for pushing fuel material from the accumulation chamber into the inlet end of the burning chamber, a hopper positioned above the accumulation chamber for receiving fuel material to be delivered to the accumulation chamber, an air lock chamber positioned between the hopper and the accumulation chamber, a first gate between the hopper and the air lock chamber for passing the fuel material from the hopper to the air lock chamber when opened and preventing the passage of smoke from the air lock chamber to the hopper when closed, a second gate between the air lock chamber and the accumulation chamber for passing the fuel material from the air lock chamber to the accumulation chamber when opened and preventing the passage of smoke from the accumulation chamber to the air lock chamber when closed, circulating coolant means for cooling the air lock chamber, the accumulation chamber, and the means for pushing the fuel material from the accumulation chamber to the burning chamber.

45. In a method of burning wood and other fuel materials in a system having an elongated burning chamber, an accumulation chamber at the inlet end of the burning chamber, a hopper, and an air lock chamber with inlet and outlet gates positioned between the hopper and the accumulation chamber, the steps of: placing the fuel material in the hopper with the inlet gate closed to prevent the passage of smoke from the air lock chamber to the hopper, opening the inlet gate to pass the fuel material from the hopper to the air lock chamber with the outlet gate closed to prevent the passage of smoke from the burning chamber to the air lock chamber, closing the inlet gate after the fuel material has passed to the air lock chamber, opening the outlet gate to pass the fuel material from the air lock chamber to the accumulation chamber with the inlet gate closed to prevent the passage of smoke from the burning chamber to the hopper, transferring the fuel material from the accumulation chamber to the burning chamber, and introducing air into the accumulation chamber at a pressure higher than the pressure in the burning chamber to prevent smoke from passing out of the system through the accumulation chamber.

46. In a method of burning wood and other fuel materials in a system having an elongated burning chamber, an accumulation chamber at the inlet end of the burning chamber, a hopper, and an air lock chamber with inlet and outlet gates positioned between the hopper and the accumulation chamber, the steps of: placing the fuel material in the hopper with the inlet gate closed to prevent the passage of smoke from the air lock chamber to the hopper, opening the inlet gate to pass the fuel material from the hopper to the air lock chamber with the outlet gate closed to prevent the passage of smoke from the burning chamber to the air lock chamber, closing the inlet gate after the fuel material has passed to the air lock chamber, opening the outlet gate to pass the fuel material from the air lock chamber to the accumulation chamber with the inlet gate closed to prevent the passage of smoke from the burning chamber to the hopper, transferring the fuel material from the accumulation chamber to the burning chamber, and utilizing hot gases produced by combustion of the fuel material in the burning chamber to dry the fuel material before it is placed in the hopper.

47. The method of claim 46 wherein the fuel material is placed on a drying platform before it is placed in the hopper, and hot air from a heat exchanger connected to the outlet end of the burning chamber is passed through heating pipes in the drying platform to dry the fuel material.

* * * * *